US012276182B2

(12) United States Patent
Harneshaug

(10) Patent No.: US 12,276,182 B2
(45) Date of Patent: Apr. 15, 2025

(54) COMPLETING A WELLBORE

(71) Applicant: Saudi Arabian Oil Company, Dhahran (SA)

(72) Inventor: Tom Harneshaug, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 23 days.

(21) Appl. No.: 18/316,099

(22) Filed: May 11, 2023

(65) Prior Publication Data

US 2024/0376804 A1 Nov. 14, 2024

(51) Int. Cl.
*E21B 43/04* (2006.01)
*E21B 41/00* (2006.01)
*E21B 43/08* (2006.01)

(52) U.S. Cl.
CPC ..... *E21B 43/04* (2013.01); *E21B 41/0035* (2013.01); *E21B 43/084* (2013.01)

(58) Field of Classification Search
CPC ..... E21B 43/04; E21B 41/0035; E21B 43/084
See application file for complete search history.

(56) References Cited

U.S. PATENT DOCUMENTS 6,715,543 B1 4/2004 Svindland
7,191,833 B2 3/2007 Richards
7,398,825 B2 7/2008 Nguyen et al.
7,520,326 B1 * 4/2009 Hill ..... E21B 43/045 166/278
7,690,426 B2 * 4/2010 Misselbrook ..... E21B 43/025 166/278
8,119,574 B2 2/2012 Panga et al.
11,598,182 B2 3/2023 Brohi et al.

OTHER PUBLICATIONS

Andrea et al., "Slim Hole Multi-Zone Sand Control Completion in an Over-Pressured Gas Field: First Eni Worldwide Application," Paper presented at the Abu Dhabi International Petroleum Exhibition & Conference, Abu Dhabi, UAE, Nov. 9, 2020, 14 pages.
Berg et al., "An Improved Placement Technique for Resin-Coated Gravel in Through-Tubing Gravel Packing," Paper presented at the SPE Annual Technical Conference and Exhibition, San Antonio, Texas, Sep. 29, 2002, 10 pages.
(Continued)

*Primary Examiner* — Catherine Loikith
(74) *Attorney, Agent, or Firm* — Fish & Richardson P.C.

(57) ABSTRACT

A method and an assembly for drilling and completing a wellbore in an underbalanced condition. The wellbore is drilled with coiled tubing through a mechanically competent formation into a poorly consolidated producing formation. The coiled tubing is run from a bottom hole location to a first uphole location uphole from the bottom hole location. A permeable proppant is pumped through the coiled tubing into the wellbore at the first uphole location. The coiled tubing is pulled, while pumping the permeable proppant through the coiled tubing into the wellbore, from the first uphole location to a second uphole location uphole from the first uphole location. Pumping the permeable proppant through the coiled tubing is stopped. The coiled tubing is removed from wellbore. A mesh plug is coupled to the coiled tubing and installed at the second uphole location in the mechanically competent formation.

20 Claims, 2 Drawing Sheets

(56) References Cited

OTHER PUBLICATIONS

Durst, "Enhanced Sand Control of Multiple Branches Connected to a Single Wellbore," Paper presented at the SPE/IADC Middle East Drilling Technology Conference and Exhibition, Abu Dhabi, UAE, Jan. 26, 2016, 25 pages.
Gilchrist et al., "Advancing Horizontal Well Sand Control Technology: An OHGP Using Synthetic OBM," Paper presented at the SPE Annual Technical Conference and Exhibition, New Orleans, Louisiana, Sep. 27, 1998, 12 pages.
Gomez et al., "Novel Multi-Stage Fracturing Sand Control Technology to Improve Completion Efficiency, Early Production and Reduce Well Cost," Paper presented at the International Petroleum Technology Conference, Riyadh, Saudi Arabia, Feb. 21, 2022, 16 pages.
horiba.com [online], "Frac Sand and Proppant Size and Shape," Available on or before Oct. 2, 2023, Internet Archive: Wayback Machine URL<https://web.archive.org/web/20231002223808/https://www.horiba.com/ind/scientific/applications/metallurgy/pages/frac-sand-and-proppant-size-and-shape/>, retrieved on Mar. 25, 2024, URL <https://www.horiba.com/ind/scientific/applications/metallurgy/pages/frac-sand-and-proppant-size-and-shape/>, 5 pages.
Lougheide et al., "Horizontal Gravel Packs Successfully Deployed in Trinidad's First Multilateral Well-Planning, Implementation, and Remedial Strategies," Paper presented at the SPE Annual Technical Conference and Exhibition, Houston, Texas, Sep. 26, 2004, 16 pages.
Mohamed et al., "Integrating Lessons Learned from over 20 years of one-trip tubing-conveyed Perforating and Frac Pack/gravel Pack Applications," Paper presented at the Offshore Technology Conference, Houston, Texas, USA, May 3, 2010, 5 pages.
Prasad et al., "Advanced Combination of Proppant Fracturing and Sand Control Completion System Unlocks Gas Potential of Unconsolidated Jauf Formation in Bahrain," Paper presented at the Abu Dhabi International Petroleum Exhibition & Conference, Abu Dhabi, UAE, Nov. 9, 2020, 14 pages.

* cited by examiner

COMPLETING A WELLBORE

TECHNICAL FIELD

This disclosure relates to drilling and completing a well, in particular, a multi-lateral well drilled in an underbalanced condition in a poorly consolidated producing formation.

BACKGROUND OF THE DISCLOSURE

In oil and gas production operations, formation fluids (hydrocarbon oil and gas, along with water) flow from subterranean formations of the Earth into a well drilled from a surface of the Earth to the subterranean formations beneath the surface of the Earth. Some laterals of the multi-lateral well are drilled in the subterranean formations in an underbalanced condition. A completion assembly is positioned in the well to produce the formation fluids from the subterranean formations to the surface of the Earth. Some subterranean formations which contain formation fluids are poorly consolidated.

SUMMARY

Implementations of the present disclosure include a method and an assembly for producing formation fluids from a subterranean formation with the wellbore completion assembly, in particular, a poorly consolidated producing formation. The method includes drilling and completing a lateral wellbore in a poorly consolidated producing formation with a coiled tubing assembly. The lateral wellbore is drilled from a main wellbore. The main wellbore extends from a surface of the Earth into the subterranean formations. The lateral wellbore is drilled through a mechanically competent formation into the poorly consolidated producing formation by the coiled tubing assembly. Next, the wellbore is filled with a permeable proppant from poorly consolidated producing formation to the mechanically competent formation. A mesh plug is then installed in the wellbore in the mechanically competent formation to seal the permeable proppant in the wellbore.

These methods and assemblies to drill and complete the multi-lateral well are described in reference to using a coiled tubing assembly and underbalanced drilling. Alternatively or in addition, these methods and assemblies can be used with other drilling methods. For example, the permeable proppant and mesh plug can be used in managed pressure drilling operations.

In one aspect, a coiled tubing assembly drills and completes a wellbore. The coiled tubing assembly drills the wellbore through a mechanically competent formation into a poorly consolidated producing formation containing a hydrocarbon. The coiled tubing assembly then completes the wellbore. The coiled tubing assembly is run from a bottom hole location to a first uphole location. The first uphole location in the poorly consolidated producing formation is uphole from the bottom hole location. A permeable proppant is pumped through the coiled tubing assembly into the wellbore at the first uphole location. While pumping the permeable proppant through the coiled tubing assembly into the wellbore, the coiled tubing assembly is pulled from the first uphole location to a second uphole location. The second uphole location is in the mechanically competent formation uphole from the first uphole location. Pumping the permeable proppant through the coiled tubing assembly is stopped. The coiled tubing assembly is removed from wellbore. A mesh plug is coupled to the coiled tubing assembly. The mesh plug is run, by the coiled tubing assembly, into the wellbore to the second uphole location. The mesh plug is installed in the wellbore at the second uphole location in the mechanically competent formation.

In some implementations, after running the mesh plug into the wellbore to the second uphole location by the coiled tubing assembly, completing the wellbore includes tagging the permeable proppant at the second uphole location with the mesh plug and based on tagging the permeable proppant at the second uphole location with the meshed plug, determining a depth in the wellbore of the second uphole location.

In some implementations, completing the wellbore includes comparing the depth of the permeable proppant in the wellbore at the second uphole location to a threshold depth in the mechanically competent formation; and responsive to determining the depth in the wellbore of the permeable proppant at the second uphole location is less than the threshold depth, cleaning out the permeable proppant between the depth and the threshold depth.

In some implementations, pumping the permeable proppant through the coiled tubing assembly into the wellbore at the first uphole location includes filling a portion of the wellbore from the bottom hole location to the first uphole location with the permeable proppant.

In some implementations, during drilling the wellbore, a pressure in the wellbore is less than a formation pressure. In some implementations, during completing the wellbore, the pressure in the wellbore is greater than or equal to the formation pressure.

In some implementations, the first uphole location is between ten and twenty feet from the bottom hole location in an uphole direction from the bottom hole location.

In some implementations, the wellbore is a main wellbore and drilling the wellbore includes positioning a whipstock in the main wellbore, milling a window through an inner surface of the main wellbore into the mechanically competent formation, and drilling a lateral wellbore from the the mechanically competent formation into the poorly consolidated producing formation. In some cases, a length of the lateral wellbore is greater than or equal to 1000 feet.

In some cases, the lateral wellbore is a first lateral wellbore, the poorly consolidated producing formation is a first poorly consolidated producing formation, and the mechanically competent formation is a first mechanically competent formation. In such cases, drilling the wellbore can include, after installing the mesh plug in the first lateral wellbore at the second uphole location in the first mechanically competent formation, drilling a second lateral wellbore in a second poorly consolidated producing formation from a location in the first lateral wellbore uphole from the mesh plug. In such cases, completing the second lateral wellbore can include positioning, by the coiled tubing assembly, the permeable proppant in the second lateral wellbore and positioning a second mesh plug in a second mechanically competent formation.

In some implementations, a length of the mesh plug is between 30 and 50 feet. In some implementations, the mesh plug is configured to hold the permeable proppant between the second uphole location and the bottom hole location.

In some implementations, completing the wellbore further includes determining a volume of the wellbore between the bottom hole location and the second uphole location, and based on the volume of the wellbore between the bottom hole location and the second uphole location, determining a volume of the permeable proppant required to fill the volume of the wellbore between the bottom hole location and the second uphole location. In some cases, filling the volume of the wellbore between the bottom hole location and the second uphole location with the permeable proppant supports the poorly consolidated producing formation. In some cases, filling the volume of the wellbore between the bottom hole location and the second uphole location with the permeable proppant prevents the poorly consolidated producing formation from collapsing into the wellbore.

In some implementations, the permeable proppant filters particles produced from the poorly consolidated producing formation.

In some implementations, a permeability of the permeable proppant is between 100 and 500 Darcy.

In some implementations, the permeable proppant comprises at least one of a gravel or a gravel slurry.

In some implementations, the permeable proppant has one or more of a uniform size or uniform shape.

In another aspect, a wellbore completion, in a wellbore system having a lateral wellbore extending from a main wellbore and the lateral wellbore extending from a bottom hole location in a poorly consolidated producing formation to a first location in a mechanically competent formation uphole from the poorly consolidated producing formation, the wellbore completion includes a permeable proppant and a mesh plug. The permeable proppant fills a portion of the lateral wellbore from the bottom hole location to the first location in the mechanically competent formation. The mesh plug is positioned in the mechanically competent formation at the first location. The mesh plug holds the permeable proppant in the portion of the lateral wellbore from the bottom hole location in the poorly consolidated producing formation to the first location in the mechanically competent formation.

In yet another aspect, a wellbore completion tool includes a cylindrical body, multiple slots, a packer, and a seal. The cylindrical body has a first end and a second end. The cylindrical body defines a void extending from the first end to the second end. The slots extend through the cylindrical body from a space outside the cylindrical body to the void. The slots are sized to prevent a permeable proppant in the space outside the void from passing through the slots. The packer is coupled to an outer surface of the cylindrical body proximal the first end. The seal is coupled to the second end of the cylindrical body. The seal seats in the permeable proppant and prevents permeable proppant and fluid from entering the void at the second end.

Implementations of the present disclosure can realize one or more of the following advantages. Wellbore integrity can be improved. For example, by drilling a wellbore in a poorly consolidated producing formation with a coiled tubing assembly in an underbalanced condition and subsequently filling a portion of the wellbore corresponding to the poorly consolidated formation with the permeable proppant up to the mechanically competent formation and sealing the permeable proppant in the wellbore with a mesh plug can structurally support the portion of the wellbore corresponding to the poorly consolidated producing formation, thereby improving wellbore integrity. In some cases, structurally supporting the wellbore in the poorly consolidated producing formation can prevent the wellbore from collapsing.

These systems and methods can increase production of hydrocarbons from the poorly consolidated producing formation. For example, filling the wellbore in the poorly consolidated producing formation with the permeable proppant can filter or reduce a flow of sand from the poorly consolidated producing formation into the wellbore, improve flow of hydrocarbons from the poorly consolidated producing formation to the surface, thus increasing production of hydrocarbons from the poorly consolidated producing formation. For example, production can be increased by preventing sand from the poorly consolidated formation from accumulating in downhole locations throughout the multi-lateral wellbore. In normal sand-control operations, one or more screens are placed throughout the multi-lateral wellbore to filter sand contained in the formation fluids. In some cases, the screens can become plugged by sand particles accumulating on the outside of the screens, reducing, or even stopping formation fluid flow through the well. By keeping the sand in the poorly consolidated producing formation with the permeable proppant and mesh plug, the sand particles can be stopped at the source (the poorly consolidated producing formation) and can be prevented from accumulating and concentrated at the screens in the multi-lateral well, reducing or eliminating blockages in the multi-lateral well. In general, sand screens can become plugged when sand and particles are mobilized and move towards the screen from the poorly consolidated producing formation into the lateral wellbore. The sand screen can function to prevent the sand and particles from being produced (flowed to the surface of the Earth for further refinement), but instead, sometimes the particles and sand accumulate outside the screen in the lateral wellbore and can restrict further flow of formation fluids through the lateral wellbore to the surface. This restriction, sometimes referred to as "skin", can cause excess pressure drop and bottlenecking in the lateral wellbore. In some cases, the particles and sand are poorly sorted and have irregular shapes. Placing well sorted and/or spherically shaped proppant into the lateral wellbore can prevent sand and particles from entering the lateral wellbore. Instead, sand particles can accumulate at the interface between the open hole formation and the lateral wellbore (i.e., near the wellbore wall or surface) and proximal to the proppant which has been placed in the lateral wellbore. Thus, if plugging does occur, it can be localized at the source (a specific location) proximal the lateral wellbore surface in the poorly consolidated producing formation and not in the lateral wellbore, reducing or eliminating blockages in the lateral wellbore. Reducing or eliminating blockages in the multi-lateral well can increase productivity and production of hydrocarbons from the multi-lateral well.

These systems and methods can simplify completion procedures. For example, the permeable proppant and mesh plug assembly can be used in live wells, hence no need to kill well with damaging filter-cake material. For example, by not killing the well and maintaining underbalanced drilling conditions, faster drilling of the lateral wellbore can be performed, hole cleaning can be improved, damage to the poorly consolidated producing formation caused by drilling mud in overbalance operation can be reduced, all of which can simplify completion procedures.

These systems and methods can decrease time and complexity to complete a wellbore. For example, filling the portion of the wellbore corresponding to the poorly consolidated producing formation and installing a mesh plug can eliminate for long screens or slotted pipes which run across the whole length of the wellbore, such as a lateral wellbore. Some lengths of lateral wellbores can exceed 1,000 feet, which can be beyond rig handling limitations. By eliminating the long screens or slotted pipes, the time and complexity to complete the wellbore can be decreased. For example, the permeable proppant and mesh plug can be positioned by the coiled tubing assembly in a live well. It is not required to kill the well (increase mud weight of the drilling fluid in the wellbore above a kill threshold) to place the permeable proppant and mesh plug. In contrast, to place a long screen, it is necessary to kill the well, place the long screen in the lateral wellbore, and then decrease the mud weight to continue drilling another lateral wellbore. For example, current commonly used and available rig equipment such as risers and lubrications can be used. Use of a mesh-plug between 30 and 50 feet to prevent the permeable proppant from being produced out can fit within current height limitations of risers and lubricators.

These systems and methods can enable completion of lateral wellbores drilled in an underbalanced condition in poorly consolidated formations. For example, some lateral wellbores are completed by running long screens typically along a large portion of a lateral (>1000'). However, the risers/lubricator height limitations of coiled tubing rigs can prevent such long screens from being run safely in a live well. By completing the lateral wellbore with the permeable proppant and the mesh plug, the need for long screens can be eliminated, enabling the completion of the lateral wellbore in a live well drilled by the coiled tubing assembly in an underbalanced condition in a poorly consolidated producing formation.

These systems and methods can increase wellbore production life. For example, each lateral wellbore in a multi-lateral scenario is independently completed with a separate permeable proppant and mesh plug system. Hence, plugging or damage to one lateral wellbore will not impact the performance or production of other the lateral wellbores.

These systems and methods can increase completion and production equipment life. For example, keeping the sand from the poorly consolidated producing formation in the poorly consolidated producing formation and out of the multi-lateral wellbore can reduce an amount or concentration of sand within the multi-lateral wellbore. As the formation fluid flows through the completion and production equipment, the sand in the formation fluid can erode, wear, and abrade the completion and production equipment (such as tubulars and valves), decreasing the completion and production equipment life. Reducing the amount or concentration of sand in the well can reduce erosion, wear, and abrasion on the completion and production equipment, increasing the life of the completion and production equipment. Workover operations can be reduced, which can further reduce operating costs and increase personnel safety.

These systems and methods can reduce bottlenecks in multi-lateral wellbore fluid flow. For example, multiple lateral wellbores can be drilled and completed independently from a main wellbore or from each other. In some multi-lateral wellbores, some or all of the lateral wellbores flow into a common junction before entering the main wellbore where a vertical sand screen is located at the common junction. This junction can cause a major bottleneck for flow, with the proppant, sand, and particles accumulating at the vertical sand screen and within the lateral wellbores, which can plug the well. By independently drilling and completing each lateral wellbore with an independent permeable proppant and mesh plug, the vertical sand screen is no longer needed, and the junction can be maintained unimpeded and formation fluids (gas and oil) can flow unrestricted.

Other aspects and advantages of this disclosure will be apparent from the following description made with reference to the accompanying drawings and the claims.

DETAILED DESCRIPTION

Oil and gas wells typically have one or more wellbores extending to subterranean formations in the Earth. The subterranean formations contain liquid and gaseous phases of various fluids including water, oils, and gases. The well conducts the fluids from the subterranean formations to the surface. The well can have a main wellbore with one or more lateral wellbores extending from the main wellbore. Some of the subterranean formations are mechanically competent (consolidated) and some are mechanically incompetent (poorly consolidated). A mechanically competent formation is structurally stable to maintain a shape of the wellbore throughout the producing life of the well. A mechanically incompetent formation is structurally unstable and may partially or completely fail during the producing life of the well or is unable to maintain the shape of the wellbore. When a wellbore is drilled in a poorly consolidated formation, the wellbore can partially or fully collapse, and/or particles from the poorly consolidated formation (often referred to as sand-production or fines-production) can be produced and transported with the flow of formation fluids (i.e., gas, oil, and/or water). Production of sand particles can cause safety issues and/or erosion of wellbore equipment and surface equipment. Also, sand and particles from the poorly consolidated formation can cause plugging of the well, such as plugging screens in the completion, and therefore reducing or stopping a flow of hydrocarbons from the poorly consolidated producing formation into the wellbore and to the surface.

The present disclosure relates to an assembly and a method for drilling and completing a wellbore in a poorly consolidated producing formation with a coiled tubing assembly. The wellbore is drilled into the poorly consolidated producing formation with the coiled tubing assembly. The coiled tubing assembly is moved in an uphole direction from the poorly consolidated producing formation to a location in a mechanically competent formation while pumping a permeable proppant (e.g. gravel or a gravel slurry) into the wellbore to fill the wellbore. A mesh plug is installed at the location in the mechanically competent formation to seal the permeable proppant in the wellbore. The mesh plug and the permeable proppant structurally support the wellbore in the poorly consolidated producing formation while allowing hydrocarbons to flow from the poorly consolidated producing formation into the wellbore and through the permeable proppant and mesh plug to the surface.

Figure 1:
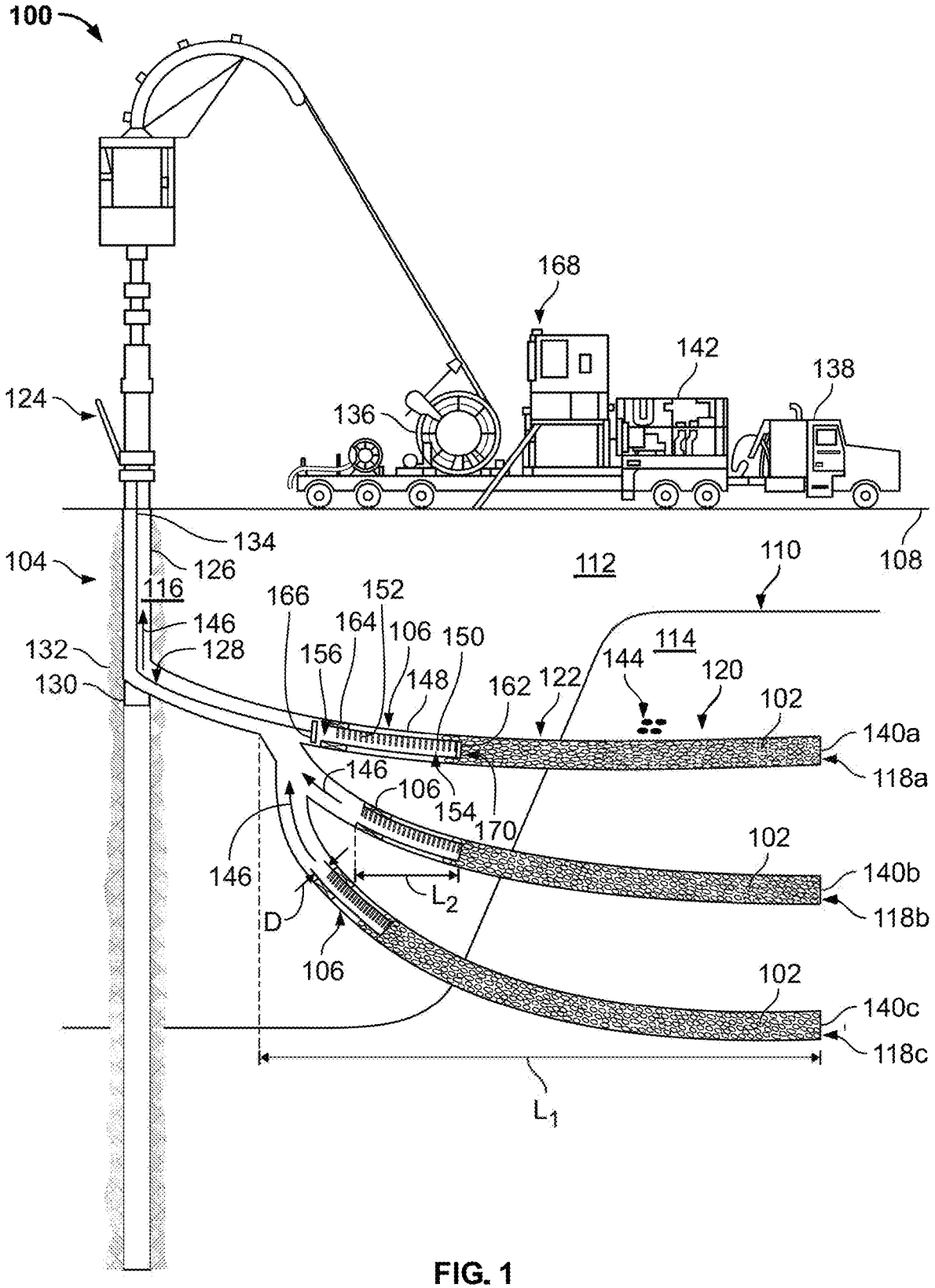
FIG. 1 is a schematic view of a coiled tubing assembly drilling and completing a wellbore in a subterranean formation.

FIG. 1 is a schematic view of a coiled tubing assembly drilling and completing a wellbore in a subterranean formation. A wellbore completion 100 has a permeable proppant 102 sealed in a well 104 by a mesh plug 106 to structurally support the well 104. The well 104 is drilled and completed (with the permeable proppant 102 and the mesh plug 106) by the coiled tubing assembly 168. The permeable proppant 102, the mesh plug 106, and the coiled tubing assembly 168 are described in more detail below.

The well 104 extends from a surface 108 of the Earth 110 through multiple subterranean formations, such as a mechanically competent formation 112 and a poorly consolidated producing formation 114. The mechanically competent formation 112 is a formation consisting of consolidated particles with sufficient bonding to withstand forces caused by production of liquids from the reservoir and naturally occurring stresses in the formation throughout the producing life of the well. A mechanically competent formation is structurally stable to maintain a shape of the wellbore throughout the producing life of the well 104. The poorly consolidated producing formation 114 is a formation consisting of particles 144, for example, sand particles, that have insufficient bonding to withstand the forces acting on the formation as a result of production of fluids through the formation and naturally occurring stresses in the formation. A mechanically incompetent formation is structurally unstable and may partially or completely fail or is unable to maintain the shape of the wellbore.

The mechanically competent formation 112 and the poorly consolidated producing formation 114 are each at a formation pressure and a formation temperature. The well 104 is at a wellbore pressure. In some cases, the wellbore pressure is less than the formation pressure. In some cases, the well 104 is drilled and completed in an underbalanced condition, that is, the wellbore pressure is less than the formation pressure. Drilling a lateral wellbore in a poorly consolidated formation with coiled tubing assembly 168 in an underbalanced condition can have some advantages relative to a conventional rig and overbalanced drilling. For example, utilizing the coiled tubing assembly 168 and underbalanced drilling can achieve faster drilling, less or no fluid and mud losses to into the formations, less damaging drilling fluids can be used (i.e., water and nitrogen used in underbalanced drilling vs. often damaging mixtures of mud and weight material used in conventional drilling).

The well 104 includes a main wellbore 116 extending from the surface 108. The main wellbore 116 extends generally vertical from the surface 108 of the Earth 110. In some cases, the main wellbore 116 can extend slanted (deviated) or S-shaped from the surface 108 of the Earth. The well 104 has multiple lateral wellbores 118*a*, 188*b*, and 118*c* which extend from the main wellbore 116. The lateral wellbores 118*a-c* are fluidly coupled to the main wellbore 116 and conduct fluids in the form of hydrocarbons and water from the subterranean formations (the mechanically competent formation 112 and the poorly consolidated producing formation 114) to the main wellbore 116. The main wellbore 116 conducts the fluids to the surface 108. The lateral wellbores 118*a-c* each have a length $L_1$ (shown in reference to lateral wellbore 118*c*). The lengths $L_1$ can be the same or differ. In some cases, the length $L_1$ of the lateral wellbores is greater than or equal to 1000 feet.

Some portions 120 of the lateral wellbores 118*a-c* are in the poorly consolidated producing formation 114. Other portions 122 of the lateral wellbores 118*a-c* are in the mechanically competent formation 112. The portions 120, 122 of the lateral wellbores 118*a-c* are open hole, in other words, not cased. The open hole portions 120, 122 allow fluids in the formations 112, 114 to flow from the formations 112, 114 into the lateral wellbores 118*a-c*. Each of the lateral wellbores 118*a-c* have a respective bottom hole location 140*a-c*. The bottom hole locations 140*a-c* define the termination or toe of the respective lateral wellbore 118*a-c*.

The well 104 has a wellhead assembly 124 positioned on the surface 108 of the Earth 110 to control a flow of fluid to and from the well 104 and allow the coiled tubing assembly 168 to pass into the well 104. The well 104 has a casing 126. The casing 126 can include one or more casing sections such as a conductor, a surface casing, an intermediate casing, and/or a production casing. The well 104 has cement 132 sealing the casing 126 to the Earth 110.

The well 104 has a window 128 extending through the casing 126 and fluidly coupling the main wellbore 116 to the lateral wellbores 118*a-c*. A whipstock 130 is placed in the main wellbore 116 and positioned to orient and direct the coiled tubing assembly to drill the window 128 and the lateral wellbores 118*a-c* and pass the coiled tubing assembly 168 into the lateral wellbores 118*a-c*. The whipstock 130 is a wedge-shaped device used to angle the coiled tubing assembly 168 to drill the lateral wellbores 118*a-c* from the main wellbore 116.

The coiled tubing assembly 168 includes a coiled tubing pipe 134 deployable from a coiled tubing reel 136 on a coiled tubing truck 138 on the surface 108. The coiled tubing pipe 134 is tripped in hole (positioned in the well 104) and tripped out of hole (removed from the well 104) by operators on the surface 108 to drill and complete the well 104. The coiled tubing pipe 134 is wrapped about the coiled tubing reel 136. The coiled tubing reel 136 is positioned proximal to the wellhead assembly 124 to position the coiled tubing pipe 134 through the wellhead assembly 124 into the well 104. The coiled tubing reel 136 rotate in a clockwise or counterclockwise direction to increase or decrease a length of the coiled tubing pipe 134 in the well 104. The coiled tubing assembly 168 can include a drill bit (not shown) to drill the lateral wellbores 118*a-c*.

The coiled tubing assembly 168 includes a pump 142 to pump the permeable proppant/carrier fluid mixture 102 from the surface 108 through the coiled tubing pipe 134 and into the lateral wellbores 118*a-c*. The permeable proppant/carrier fluid mixture 102 can also be referred to as the permeable proppant 102 or proppant 102. The permeable proppant 102 is positioned in the portion 120 of the lateral wellbores 118*a-c* corresponding to the poorly consolidated producing formation 114 to support the well 104. The permeable proppant 102 can extend into the portion 122 of the lateral wellbores 118*a-c* corresponding to the mechanically competent formation 112. In some cases, supporting the poorly consolidated producing formation 114 can prevent the poorly consolidated producing formation 114 from collapsing, and reducing or stopping flow of formation fluids to the surface 108. The permeable proppant 102 can filter the particles 144 to prevent the particles 144 from entering the lateral wellbores 118*a-c*. The permeable proppant 102 is positioned in the portions 120, 122 by being pumped (flowed) through the coiled tubing pipe 134 when the coiled tubing pipe 134 is positioned in one of the lateral wellbores 118*a-c* by the coiled tubing assembly 168.

The permeable proppant 102 can be a gravel or a gravel slurry. In some cases, the permeable proppant 102 has a characteristic. For example, the characteristic can be a diameter of the permeable proppant 102. In some cases, the diameter of the permeable proppant is between 8 to 140 mesh (0.105 μm-2.36 mm). The permeable proppant 102 can be selected to have a diameter to allow the formation fluids to flow through the lateral wellbores 118*a-c*. The size (diameter) and range of diameters of the permeable proppant 102 can be selected to stop (filter) the typical particles size of sand and particles in the poorly consolidated producing formation 114 from entering the well 104 while the permeability of the permeable proppant 102 is maximized.

The permeable proppant 102 filling the portions 120, 122 allows the fluids in the formations 112, 114 to flow into the lateral wellbores 118*a-c*. The permeable proppant 102 can have a permeability between 100 and 500 Darcy.

The mesh plug 106 is positioned in well 104 in the lateral wellbores 118*a-c* in the portion 122 of the mechanically competent formation 112 to keep the permeable proppant 102 in the lateral wellbores 118*a-c* and allow the fluids including hydrocarbons and water to flow from the permeable proppant 102 in the lateral wellbores 118*a-c* into the main wellbore 116 and to the surface in the direction of arrows 146. In some cases, the mesh plug 106 contacts the permeable proppant 102. The mesh plug 106 is sealed to an inner surface 148 of the lateral wellbores 118*a-c*.

The mesh plug 106 has a length $L_2$, shown relative to the mesh plug 106 positioned in lateral wellbore 118*b*. In some cases, the length $L_2$ of the mesh plug 106 is between 30 and 50 feet.

The mesh plug 106 has a diameter D, shown relative to the mesh plug 106 positioned in lateral wellbore 118*b*. In some cases, the diameter D of the mesh plug 106 is between 2" and 5⅞". The diameter D of the mesh plug is selected so the mesh plug 106 fits in one of the lateral wellbores 118*a-c*. In some cases, the lateral wellbores 118*a-c* have diameter of 3⅝" (a typical diameter for coiled tubing drilling operations) and between 5⅞" or 8⅜" (a typical diameter for managed pressure drilling operations).

The mesh plug 106 has a cylindrical body 150 with slots 152 extending through the cylindrical body. The slots 152 conduct the fluids from a space 154 outside the mesh plug 106 but within the lateral wellbore 118*a-c* in the portion 122 of the mechanically competent formation 112 to a void 156 within the cylindrical body 150. The fluids flow from the void 156 in the direction of arrows 146 to the main wellbore 116. In some cases, the slots are circular. The slots 152 are sized, that is, they have physical properties such as a shape, volume, cross-section, length, width, or diameter to hold the particles 144 in the formations 112, 114. In some cases, the cylindrical body 150 is a screen.

The mesh plug 106 has a seal 162 coupled to a downhole end 170 of the cylindrical body 150. The seal 162 can contact the permeable proppant 102. The seal 162 can be referred to as a plug. The seal 162 prevents permeable proppant 102 and fluids from entering the cylindrical body 150 from the downhole end 170. The seal 162 terminates the mesh plug 106 with a material that is tight and does not allow fluids or proppant 102 to pass. The seal 162 can be a polymer or a metal.

The mesh plug 106 has a packer 164 coupling the mesh plug 106 to the inner surface 148 of the lateral wellbores 118*a-c*. The packer 164 is actuated from a first position disengaged from the inner surface 148 to a second position engaged to the inner surface 148 of the lateral wellbores 118*a-c*. For example, the packer 164 can be an expandable packer or an actuatable packer. The packer 164 can be included with and placed with the mesh plug 106. In some cases, the mesh plug 106 is first positioned in the lateral wellbores 118*a-c*, and the packer 164 is then coupled to the mesh plug 106 and actuated to seal against the inner surface 148 of the lateral wellbores 118*a-c*.

The mesh plug 106 is placed in one of the lateral wellbores 118*a-c* by a setting tool 166 (shown coupled to the mesh plug 106 in lateral wellbore 118*a*) coupled to the coiled tubing pipe 134. In some cases, the setting tool 166 can actuate the packer 164 to seal the packer 164 against the inner surface 148 of the lateral wellbores 118*a-c*. Once the mesh plug 106 is installed in the portion 122 of the mechanically competent formation 112, the setting tool 166 is disengaged from the mesh plug 106 and removed from the well 104 by the coiled tubing assembly 168.

Figure 2:
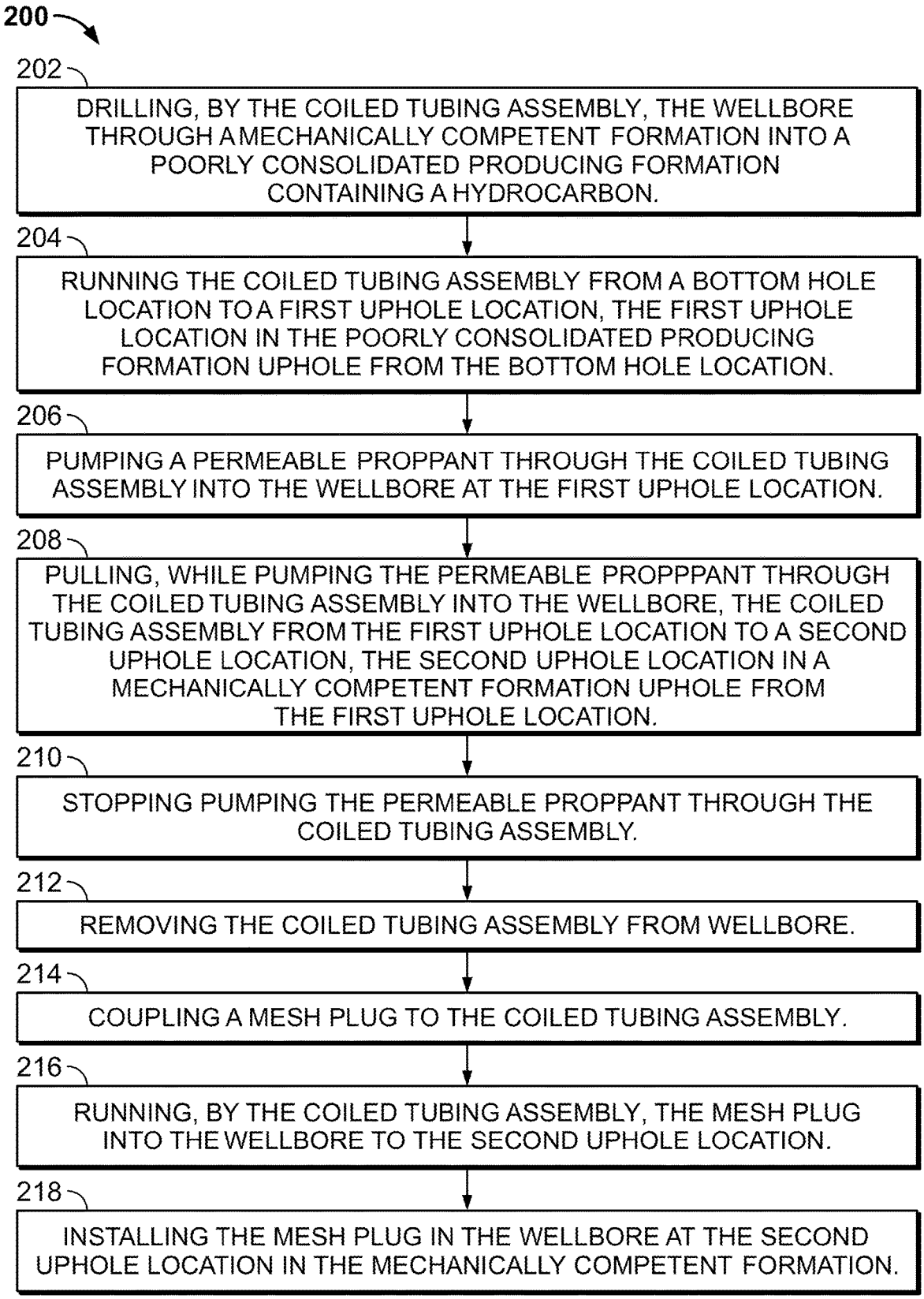
FIG. 2 is a flow chart of an example method of drilling and completing a formation according to the implementations of the present disclosure.

FIG. 2 is a flow chart of an example method 200 of drilling and completing a wellbore with a coiled tubing assembly according to the implementations of present disclosure. At 202, the lateral wellbore is drilled by the coiled tubing assembly from a main wellbore through a mechanically competent formation into a poorly consolidated producing formation containing a hydrocarbon. For example, referring to FIG. 1, the coiled tubing assembly 168 kicks the coiled tubing pipe 134 off the whipstock 130 to drill the lateral wellbore 118*a*. The lateral wellbore 118*a* is drilled from the mechanically competent formation 112 into the poorly consolidated producing formation 114 to the bottom hole location 140*a*.

In some cases, the wellbore is a main wellbore and drilling the wellbore includes positioning the whipstock in the main wellbore, milling a window through an inner surface of the main wellbore, and drilling the lateral wellbore from the window of the main wellbore into the poorly consolidated producing formation. For example, referring to FIG. 1, the coiled tubing assembly 168 positions the whipstock 130 in the main wellbore 116 by the coiled tubing pipe 134, and then the coiled tubing pipe 134 is retracted to the surface 108 and mill (not shown) is coupled to the coiled tubing pipe. The mill is tripped in the main wellbore 116 and oriented by the whipstock 103 to drill the window 128 in the main wellbore 116. The coiled tubing pipe 134 is then tripped out of the well 104 and replaced by the drill bit. The drill bit is then tripped into the well 104, directed through the window 128, and then rotated by the coiled tubing assembly 168 to drill the lateral wellbores 118*a*. The lateral wellbores 118*a* is drilled from the mechanically competent formation 112 into the poorly consolidated producing formation 114 to the bottom hole location 140*a*.

In some cases, a length of the lateral wellbore is greater than or equal to 1000 feet. For example, referring to FIG. 1, the length $L_1$ of one or more of the lateral wellbores 118*a-c* can be greater than or equal to 1000 feet. In some cases, the length $L_1$ of the lateral is 2,500 feet.

In some cases, a pressure in the wellbore is less than a formation pressure. For example, referring to FIG. 1, either or both of the mechanically competent formation 112 or the poorly consolidated producing formation 114 can have a pressure less than the pressure in the well 104. While drilling the lateral wellbores 118*a-c*, the pressure in the lateral wellbores 118*a-c* can be decreased to less than the formation pressure (i.e., underbalanced drilling). In some cases, while pumping the permeable proppant 102, the pressure is balanced with or greater than the formation pressure, otherwise the permeable proppant 102 can flow out of the well 104. Once the mesh plug 106 has been set, the pressure can again be decreased, i.e., underbalanced, while drilling the next lateral wellbore 118*b,c* in the event many lateral wellbores 118*a-c* are to be drilled.

At 204, the coiled tubing assembly is run from a bottom hole location to a first uphole location. The first uphole location in the poorly consolidated producing formation is uphole from the bottom hole location. For example, referring to FIG. 1, the bottom hole location 140*a* is in the lateral wellbore 118*a*. The first uphole location is within the portion 120 of the lateral wellbore 118*a* corresponding to the poorly consolidated producing formation 114 and off the bottom hole location 140*a*.

In some cases, the first uphole location is between ten and twenty feet from the bottom hole location in an uphole direction from the bottom hole location. For example, referring to FIG. 1, the first uphole location can be off the bottom hole location 140*a* of lateral wellbore 118*a* in the portion 120 of the lateral wellbore 118*a* proximal to the poorly consolidated producing formation 118*a* in the direction of arrows 146 (the uphole direction).

At 206, a permeable proppant is pumped through the coiled tubing assembly into the wellbore at the first uphole location. For example, referring to FIG. 1, the permeable proppant 102 is pumped by the pump 142 through the coiled tubing pipe 134 extending through the wellhead assembly 124, the main wellbore 116, and into the lateral wellbore 118*a*.

In some cases, the permeable proppant filters a particle produced from the poorly consolidated producing formation. For example, referring to FIG. 1, the particles 144 are prevented from flowing out of the poorly consolidated producing formation 114 and into the lateral wellbore 118*a* by the permeable proppant 102. In some cases, the particles 144 are sand.

In some cases, a permeability of the permeable proppant 102 is between 100 and 500 Darcy. In some cases, the permeable proppant 102 is gravel or a gravel slurry. In some cases, the permeable proppant has one or more of a uniform size or uniform shape.

In some cases, pumping the permeable proppant through the coiled tubing assembly into the wellbore at the first uphole location comprises filling a portion of the wellbore from the bottom hole location to the first uphole location with the permeable proppant. For example, referring to FIG. 1, the portion 120 of the lateral wellbore 118*a* within the poorly consolidated producing formation 114 from the bottom hole location 140*b* while the coiled tubing assembly 168 is off the bottom hole location 140*a* between 10 and 20 feet fills the lateral wellbore 118*a* from the bottom hole location 140*a* up to the first uphole location with the permeable proppant 102.

At 208, while pumping the permeable proppant through the coiled tubing assembly into the wellbore, the coiled tubing assembly is pulled from the first uphole location to a second uphole location. The second uphole location is in a mechanically competent formation uphole from the first uphole location. For example, referring to FIG. 1, the second uphole location is within the lateral wellbore 118*a* in the portion 122 surrounded by the mechanically competent formation 112. The coiled tubing pipe 134 is pulled in the lateral wellbore 118*a* from portion 120 within the poorly consolidated producing formation 114 to the portion 122 within the mechanically competent formation 112 while permeable proppant 102 is pumped out the coiled tubing pipe 134 to fill the lateral wellbore 118*a* up to the second uphole location in the mechanically competent formation 112.

At 210, pumping the permeable proppant through the coiled tubing assembly is stopped. For example, referring to FIG. 1, the pump 142 is stopped, stopping the flow of the permeable proppant through the coiled tubing pipe 134.

At 212, the coiled tubing assembly is removed from wellbore. For example, referring to FIG. 1, the reel 136 is rotated to remove the coiled tubing pipe 134 from the well 104 via the wellhead assembly 124.

At 214, a mesh plug is coupled to the coiled tubing assembly. For example, referring to FIG. 1, the mesh plug 106 can be coupled to the setting tool 166 at the surface 108. In some cases, a length of the mesh plug is between 30 and 50 feet. For example, referring to FIG. 1, the length $L_2$ of the mesh plug is between 30 and 50 feet.

At 216, the mesh plug is run, by the coiled tubing assembly, into the wellbore to the second uphole location. In some cases, after running the mesh plug by the coiled tubing assembly into the wellbore to the second uphole location, the method further includes tagging the permeable proppant at the second uphole location with the mesh plug; and based on tagging the permeable proppant at the second uphole location with the meshed plug, determining a depth in the wellbore of the second uphole location. For example, referring to FIG. 1, the coiled tubing pipe 134 with the mesh plug 106 attached to the setting tool 166 is run downhole through the main wellbore 116 and into the lateral wellbore 118*a* to contact (tag) the permeable proppant 102. The length of coiled tubing pipe 134 deployed from the reel 136 determines a depth of the permeable proppant 102 in the lateral wellbore 118*a* from the surface 108, also corresponding to the depth of the second uphole location in the mechanically competent formation 112. In some cases, the coiled tubing assembly 168 includes a controller (not shown) which receives signals from sensors on the reel 136 indicated the length of coiled tubing pipe 134 deployed and based on the signals representing the length of the coiled tubing pipe 134 deployed, calculate the depth of one or more of the bottom hole location 140*a*, the first uphole location (the depth off the bottom hole location 140 in the portion 120), the second uphole location (a top of the permeable proppant 102), or a depth of the mesh plug 106.

At 218, the mesh plug is installed in the wellbore at the second uphole location in the mechanically competent formation. For example, referring to FIG. 1, the setting tool 166 can actuate the packer 164 to seal the mesh plug 106 to the inner surface 148 of the lateral wellbore 118*a*.

In some cases, the mesh plug is configured to hold the permeable proppant between the second uphole location and the bottom hole location. For example, referring to FIG. 1, the mesh plug 106 holds the permeable proppant 102 in the lateral wellbore 118*a* between the bottom hole location 140 and the mesh plug 106 installed in the mechanically competent formation 112.

In some cases, the drilling and completing the wellbore further includes determining a volume of the wellbore between the bottom hole location and the second uphole location; and based on the volume of the wellbore between the bottom hole location and the second uphole location, determining a volume of the permeable proppant required to fill the volume of the wellbore between the bottom hole location and the second uphole location. For example, referring to FIG. 1, based on the depths of the bottom hole location, the first uphole location, the second uphole location, the depth of the mesh plug, and the diameter of the lateral wellbore 118*a*, the controller can determine a volume of one or more of the respective sections of the lateral wellbore 118*a*. The controller can further, based on the physical properties of the permeable proppant 102, determine the volume of the permeable proppant required to fill the respective sections of the lateral wellbore 118*a*.

In some cases, filling the volume of the wellbore between the bottom hole location and the second uphole location with the permeable proppant supports the poorly consolidated producing formation. In some cases, filling the volume of the wellbore between the bottom hole location and the second uphole location with the permeable proppant prevents the poorly consolidated producing formation from collapsing into the wellbore. For example, referring to FIG. 1, the permeable proppant 102 can fill the lateral wellbore 118*a* and mechanically support the poorly consolidated producing formation 114.

In some cases, after filling the lateral wellbore 118*a* with the permeable proppant and before removing the coiled tubing pipe 134, the method can include comparing the depth of the permeable proppant in the wellbore at the second uphole location to a threshold depth in the mechanically competent formation; and responsive to determining the depth in the wellbore of the permeable proppant at the second uphole location is less than the threshold depth, cleaning out the permeable proppant between the depth and the threshold depth. For example, referring to FIG. 1, a cleanout fluid such as drilling mud or water can be pumped downhole through the coiled tubing pipe 134 to remove an excess portion of permeable proppant 102 in the portion 122 of the lateral wellbore 118*a* with in the mechanically competent formation 112.

In some cases, the lateral wellbore is a first lateral wellbore, the poorly consolidated producing formation is a first poorly consolidated producing formation, and the mechanically competent formation is a first mechanically competent formation. In such cases, after installing the mesh plug in the main wellbore at the second uphole location in the first mechanically competent formation, drilling and completing the wellbore includes drilling a second lateral wellbore from the main wellbore uphole from the first lateral wellbore in a second poorly consolidated producing formation; and completing the second lateral wellbore by positioning, by the coiled tubing assembly, the permeable proppant in the second lateral wellbore and a second mesh plug in a second mechanically competent formation. For example, referring to FIG. 1, the well 104 can include lateral wellbores 118*a-c*. In some cases, the well 104 can include between one and five, or even more lateral wellbores 118*a-c*. Each subsequent lateral wellbore 118*b-c* can be drilled in the underbalanced condition.

While the disclosure includes a limited number of embodiments, those skilled in the art, having benefit of this disclosure, will appreciate that other embodiments can be devised which do not depart from the scope of the present disclosure. Accordingly, the scope should be limited only by the attached claims.

The invention claimed is:

1. A method of drilling and completing a wellbore with a coiled tubing assembly, the method comprising:

drilling, by the coiled tubing assembly, the wellbore through a mechanically competent formation into a poorly consolidated producing formation containing a hydrocarbon; and completing the wellbore by:

running the coiled tubing assembly from a bottom hole location to a first uphole location, the first uphole location in the poorly consolidated producing formation uphole from the bottom hole location;

pumping a permeable proppant through the coiled tubing assembly into the wellbore at the first uphole location;

pulling, while pumping the permeable proppant through the coiled tubing assembly into the wellbore, the coiled tubing assembly from the first uphole location to a second uphole location, the second uphole location in the mechanically competent formation uphole from the first uphole location;

stopping pumping the permeable proppant through the coiled tubing assembly;

removing the coiled tubing assembly from wellbore;

coupling a mesh plug to the coiled tubing assembly;

running, by the coiled tubing assembly, the mesh plug into the wellbore to the second uphole location; and installing the mesh plug in the wellbore at the second uphole location in the mechanically competent formation.

2. The method of claim 1, after running, by the coiled tubing assembly, the mesh plug into the wellbore to the second uphole location, the method further comprises:

tagging the permeable proppant at the second uphole location with the mesh plug; and based on tagging the permeable proppant at the second uphole location with the meshed plug, determining a depth in the wellbore of the second uphole location.

3. The method of claim 2, further comprising:

comparing the depth of the permeable proppant in the wellbore at the second uphole location to a threshold depth in the mechanically competent formation; and responsive to determining the depth in the wellbore of the permeable proppant at the second uphole location is less than the threshold depth, cleaning out the permeable proppant between the depth and the threshold depth.

4. The method of claim 1, wherein pumping the permeable proppant through the coiled tubing assembly into the wellbore at the first uphole location comprises filling a portion of the wellbore from the bottom hole location to the first uphole location with the permeable proppant.

5. The method of claim 1, wherein:

during drilling the wellbore, a pressure in the wellbore is less than a formation pressure; and during completing the wellbore, the pressure in the wellbore is greater than or equal to the formation pressure.

6. The method of claim 1, wherein the first uphole location is between ten and twenty feet from the bottom hole location in an uphole direction from the bottom hole location.

7. The method of claim 1, wherein the wellbore is a main wellbore, drilling the wellbore comprises:

positioning a whipstock in the main wellbore;

milling a window through an inner surface of the main wellbore;

drilling a lateral wellbore from the window of the main wellbore into the mechanically competent formation; and drilling the lateral wellbore from the mechanically competent formation into the poorly consolidated producing formation.

8. The method of claim 7, wherein the lateral wellbore is a first lateral wellbore, the poorly consolidated producing formation is a first poorly consolidated producing formation, and the mechanically competent formation is a first mechanically competent formation, after installing the mesh plug in the first lateral wellbore at the second uphole location in the first mechanically competent formation, the method further comprises:

drilling a second lateral wellbore in a second poorly consolidated producing formation from a location in the first lateral wellbore uphole from the mesh plug; and completing the second lateral wellbore by positioning, by the coiled tubing assembly, the permeable proppant in the second lateral wellbore and a second mesh plug in a second mechanically competent formation.

9. The method of claim 7, wherein a length of the lateral wellbore is greater than or equal to 1000 feet.

10. The method of claim 1, wherein a length of the mesh plug is between 30 and 50 feet.

11. The method of claim 1, wherein the mesh plug is configured to hold the permeable proppant between the second uphole location and the bottom hole location.

12. The method of claim 1, further comprising:

determining a volume of the wellbore between the bottom hole location and the second uphole location; and based on the volume of the wellbore between the bottom hole location and the second uphole location, determining a volume of the permeable proppant required to fill the volume of the wellbore between the bottom hole location and the second uphole location.

13. The method of claim 12, wherein filling the volume of the wellbore between the bottom hole location and the second uphole location with the permeable proppant supports the poorly consolidated producing formation.

14. The method of claim 12, wherein filling the volume of the wellbore between the bottom hole location and the second uphole location with the permeable proppant prevents the poorly consolidated producing formation from collapsing into the wellbore.

15. The method of claim 1, wherein the permeable proppant filters particles produced from the poorly consolidated producing formation.

16. The method of claim 1, wherein a permeability of the permeable proppant is between 100 and 500 Darcy.

17. The method of claim 1, wherein the permeable proppant comprises at least one of a gravel or a gravel slurry.

18. The method of claim 1, wherein the permeable proppant has one or more of a uniform size or uniform shape.

19. A wellbore completion assembly, the wellbore completion assembly configured to be positioned in a wellbore system comprising a lateral wellbore extending from a main wellbore, the lateral wellbore extending from a bottom hole location in a poorly consolidated producing formation to a first location in a mechanically competent formation uphole from the poorly consolidated producing formation, the wellbore completion assembly comprising:

a permeable proppant configured to fill a portion of the lateral wellbore from the bottom hole location to the first location in the mechanically competent formation;

a mesh plug configured to be positioned in the lateral wellbore at the first location proximal the mechanically competent formation, the mesh plug sealed to an inner surface of the lateral wellbore at the first location, the mesh plug configured to hold the permeable proppant in the portion of the lateral wellbore from the bottom hole location in the poorly consolidated producing formation to the first location in the mechanically competent formation;

a coiled tubing assembly configured to place the permeable proppant and the mesh plug in the wellbore system; and a controller operatively coupled to the coiled tubing assembly, the controller configured to perform operations comprising determining a volume of a portion of the wellbore system.

20. The wellbore completion assembly of claim 19, wherein the controller is further configured to perform operations comprising:

receiving signals representing a length of a coiled tubing pipe of the coiled tubing assembly deployed in the wellbore system;

calculating a depth of one or more of the bottom hole location, the first location, a second location corresponding to a top of the permeable proppant, or the mesh plug based on the signals representing the length of the coiled tubing pipe;

determining the volume of the portion of the wellbore system, wherein the volume of the portion is defined between the bottom hole location and the first location, the second location corresponding to the top of the permeable proppant, or the mesh plug based on the depth of the bottom hole location, the depth of the first location, the depth of the second location, or the depth of the mesh plug; and determining a volume of the permeable proppant required to fill the volume of the portion of the wellbore system.

* * * * *